US005107573A

United States Patent [19]

Zhang

[11] Patent Number: 5,107,573

[45] Date of Patent: Apr. 28, 1992

[54] ROTATING CONNECTOR

[76] Inventor: Ning Zhang, 11-5-10 Shui Nian He Bei Er Street, Cheng Du City, Sichuan Province, China

[21] Appl. No.: 728,288

[22] Filed: Jul. 11, 1991

Related U.S. Application Data

[63] Continuation of Ser. No. 641,695, Jan. 16, 1991, abandoned.

[51] Int. Cl.[5] ..... A44B 1/38

[52] U.S. Cl. ..... 24/706.4; 24/104; 24/109; 24/708

[58] Field of Search ..... 24/706.4, 706.5, 706.6, 24/707.8, 708, 590, 104, 109

[56] References Cited

U.S. PATENT DOCUMENTS

| | | | |
|---|---|---|---|
| 339,848 | 4/1886 | Bitter | 24/104 |
| 547,410 | 10/1895 | Beaumont | 24/109 |
| 758,602 | 4/1904 | Brownley . | |
| 1,348,629 | 8/1920 | Cushman . | |
| 1,474,352 | 11/1923 | Folkman . | |
| 2,843,903 | 7/1958 | Chaves | 24/109 |
| 2,874,433 | 2/1959 | La Rue et al. . | |
| 3,401,433 | 9/1968 | Marx et al. | 24/104 |
| 3,691,597 | 9/1972 | Kahn | 24/109 |
| 4,400,856 | 8/1983 | Tseng | 24/109 |

FOREIGN PATENT DOCUMENTS

| | | | |
|---|---|---|---|
| 0251757 | 11/1910 | Fed. Rep. of Germany | 24/109 |
| 0704219 | 5/1931 | France | 24/109 |

*Primary Examiner*—Victor N. Sakran
*Attorney, Agent, or Firm*—Christie, Parker & Hale

[57] ABSTRACT

A rotating connector, which is especially suitable to assemble a button or a badge etc. to the clothing or other articles of daily use, and to lap the flat pieces of things such as packsack belts, wherein, said connector is composed of a fixed unit and a combined fastening part, and two parallel fixed bolts which are extended outward are fixed on the one side of said fixed unit, and a neck section is formed on the end part of said fixed bolt; and the combined fastening part is composed of a plug-in block and a buckling unit which can be rotated relative to the plug-in block; the fixed bolt is inserted into the rabbet on the plug-in block, and then the buckling unit is rotated to make the arc guide groove buckle the neck section on the fixed bolt to complete the connection. This connector is low in cost, quick in assembling and disassembly, exact in circumferentially positioned and reliable in connecting.

25 Claims, 8 Drawing Sheets

ROTATING CONNECTOR

This is a continuation of application Ser. No. 07/641,695 filed Jan. 16, 1991 ; now abandoned

INTRODUCTION:

The present invention is related to a kind of quick-assembling and quick-disassembling connector which is suitable to assemble various ornaments, buttons and badges etc. onto the clothing or other articles of daily use, or to assemble curtain catches to the curtain, and also to lap two or more flat pieces of things together, for example, to lap the packsack belts together, which function is same as the function of a rivet.

BACKGROUND OF THE INVENTION

Today, the common assembling method which is used to assemble buttons or badges to the clothing or other articles of daily use is by means of sewing or fastening with pins or clips. It is inconvenient to sew buttons onto the clothing and to disassemble the buttons so as to be convenient in scouring and ironing. To fasten the badges with pins or clips may stab and wound the wearer's body. So a kind of assembling method is proposed, which assembles buttons or badges to the clothing or other articles of daily use by means of a screw bolt fixed on the back of a button or a badge fitting with a nut; in this assembling method, not only it is inconvenient to assemble and disassemble, but also the connector is difficult to fix position circumferentially, and easy to loosen, and this kind of bolt-nut connecting unit is high in cost. Another connecting method is that a fastening needle fixed on the back of a button or a badge is inserted into a gap between a number of steel balls in a taper sleeve, in which a spring presses the steel balls to compress the gap between the steel balls to clip said fastening needle, and therefore the button or the badge is assembled onto the clothing or other articles of daily use. This connecting method is a quick-connecting method, but the connecting reliability is low, in particularly, the connecting unit needs a high technology level, and therefore is high in manufacturing cost.

So the object of the present invention is to propose a new kind of rotating connector which is low in cost and is quick-assembling and quick-disassembling, and which is not easy to loosen in connecting status, is high in connecting reliability, and is convenient and exact in circumferentially positioned.

SUMMARY OF THE INVENTION

The present invention proposes a rotating connector in which a fixed unit is buckled and connected with a combined fastening part by means of inserting face-to-face and rotating. Two or more parallel fixed bolts which are extended outward are fixed on one side of said fixed unit. It would be best that the number of said fixed bolts is two, which may also be three or four to improve the connecting reliability. A neck section is formed on the end part of each said fixed bolt, and if the connector is used to lap the flat pieces of things such as packsack belts etc., more than one neck sections are formed alternatively on the end part of said fixed bolt to clip the flat pieces of things with various thicknesses.

Said combined fastening part is composed of a plug-in block and a buckling unit. Said buckling unit can be rotated relative to said plug-in block. Some rabbets which are corresponded to the head of said fixed bolt are arranged on the plug-in block, and some arc guide grooves corresponding to said fixed bolts are formed on the buckling unit. The corresponding end of each said arc guide groove is arc, which diameter is longer than the width of the arc guide groove. The width of said arc guide groove is longer than the diameter of the neck section of said fixed bolt and shorter than the diameter of the head of said fixed bolt. For practicable use, when the rabbets on the plug-in block are aligned with the end arc parts of the arc guide grooves, the fixed bolts on the fixed unit pierce through the clothing or other articles of daily use or packsack belts, and pass through the end arc parts of the arc guide grooves on the buckling unit and are inserted into the rabbets on the plug-in block, and then the buckling unit is rotated, so the neck section on said fixed bolt is buckled by two edges of said arc guide groove on the buckling unit to complete the connection between the fixed unit and the combined fastening part, i.e., to connect the clothing or other articles of daily use or packsack belts together.

As another embodiment, one or more flanges can be formed on the end part of the fixed bolt, and said flanges are buckled by two edges of said arc guide grooves to complete the connection.

The rotating connector proposed by the present invention can be made of plastics or metal, which is low in manufacturing cost, quick in assembling and disassembling, high in connecting reliability, convenient and exact in circumferentially positioned, and not easy to loosen and rotate free, and therefore is an ideal connector which is used to assemble the buttons, badges, and other ornaments, and lap the flat pieces of things such as packsack belts, and connect other things.

The present invention proposes a kind of rotating connector which includes a fixed unit and a combined fastening part.

Said fixed unit may be a button, a badge, a curtain catch or an ornament. Two or more parallel fixed bolts which are extended outward are fixed on one side of said fixed unit (e.g., the back of a button or a badge). Said fixed bolts may be perpendicular to the side of said fixed unit. One or more neck sections are formed on the end part of each fixed bolt. The head of said fixed bolt is taper or hemispherical.

Said combined fastening part is composed of a plug-in block and a buckling unit. Said plug-in block is a circular block. A jack-post which head is a taper flange and which is extended outward is concentrically fixed on the center of one side of said plug-in block. On the same side, two or more rabbets are arranged. The number and position, the shape and dimension of said rabbets are corresponded to the number and position of said fixed bolts, the shape and dimension of the head of said fixed bolts. Some teeth are evenly arranged on the exterior periphery of said plug-in block. The sectional shape of said tooth is curvilinear, had better be arc.

The shape of said buckling unit may be circular. Some teeth are formed on the exterior periphery of said buckling unit to avoid sliding while it is held to rotate. The shape of said buckling unit may also be a suitable shape which is convenient to be held to rotate, for example, which shape may also be the shape of the letter "8" or rectangle shape. A through cavity is concentrically formed in said buckling unit, which sectional shape is the shape of the letter "I" in which one end cavity is larger than other end cavity, and which is composed of three concentric cylinder cavities, wherein, two arc flanges which are extended toward the center line of the cavity are symmetrically arranged or more than two arc flanges which are extended toward the center line of the cavity are circumferentially and evenly arranged on the interior periphery of the largest cylinder cavity, and the diameter of the largest cylinder cavity is slightly longer than the diameter of the largest envelope line of said plug-in block, and the diameter of middle cylinder cavity is corresponded to that of said jack-post, and the diameter of the other end cylinder cavity is longer than that of the middle cylinder cavity to receive the taper head of said jack-post, so that the plug-in block is pressed and inserted into said cylinder cavity and the buckling unit can be rotated relative to the plug-in block and cannot move axially relative to the plug-in block. Some arc guide grooves are formed on the buckling unit, which number is equal to the number of said fixed bolts and which are communicated with the largest cylinder cavity. The center of the arc corresponding to said arc guide groove coincides with that of said buckling unit and the width of said arc guide groove is longer than the diameter of the neck section on said fixed bolt and shorter than the diameter of the fixed bolt. The corresponding end of each arc guide groove is arc, which diameter is longer than the width of the arc guide groove and longer than the longest diameter of the head of said fixed bolt, and the radius of the center line of said arc guide groove, i.e., the radius of the arc by which the width of said arc guide groove is evenly divided is equal to the distance between the center line of said fixed bolt and the center line of said fixed unit. Some arc shallow grooves may be arranged on the end wall of the largest cylinder cavity of the "I" shape cavity, which center line coincides with the center line of the corresponding arc guide groove and which number is equal to the number of the arc guide grooves, and which width is equal to the diameter of the end arc part of the arc guide groove and which depth decreases progressively from the end arc part to the other end of the arc guide groove so as to fasten the the unit which is to be fastened gradually with the buckling unit being rotated. But it is also practicable that there is no arc shallow groove.

It is also practicable that only one flange is formed on the end part of said fixed bolt, for example, a flat flange, wherein, the diameter of said rabbet is corresponded to the largest traverse dimension of said flat flange, and the width of said arc guide groove is longer than the diameter of said fixed bolt and shorter than the largest traverse dimension of said flat flange, and the diameter of end arc part of said arc guide groove is longer than the largest traverse dimension of said flat flange.

It is also practicable that one or more cylinder flanges with same diameter and separated from each other are arranged on the end part of said fixed bolt; in this case, the diameter of said rabbet is corresponded to the diameter of said cylinder flange, and the width of said arc guide groove is longer than the diameter of said fixed bolt and shorter than the diameter of said cylinder flange, and the diameter of end arc part of said arc guide groove is longer than that of said cylinder flange.

The plug-in block is put on the largest cavity of said "I" shape cavity on the buckling unit and is pressed in the "I" shape cavity (if the material of the buckling unit and the plug-in block is metal, heating method can be applied). The taper jack-post of said plug-in block is pressed and inserted through the middle cylinder cavity and into the other end cylinder cavity in the buckling unit and is buckled in the cylinder cavity because of the deformation of said buckling unit; and the buckling unit can be concentrically rotated relative to said plug-in block. Because two arc flanges formed on the interior periphery of said largest cylinder cavity are engaged with the teeth on the exterior periphery of said plug-in block, the buckling unit cannot rotate free, but can be rotated by hand. The rabbets on the said plug-in block are aligned with the arc end part of said arc guide grooves. If the fixed unit is a button or a badge, the fixed bolts on the fixed unit pierce through the clothing or other articles of daily use, and pass through the arc end part of said arc guide groove and are inserted into the corresponding rabbets on the plug-in block, and then the fixed unit is rotated to make the neck sections of said fixed bolts close to the other end of the arc guide groove, and therefore, the fixed bolts are buckled in the buckling unit so as to assemble the fixed unit such as a button, a badge etc. to the clothing or other articles of daily use because the diameter of said fixed bolts is longer than the width of said arc guide groove. Because there are two or more fixed bolts which pierce through the clothing or other articles of daily use, the fixed unit cannot rotate relative to the clothing or other articles of daily use so as to obtain an accurate and unchangable fixed position. To lap some flat pieces of things, same method can be used to use fixed bolts to pierce through overlapped flat pieces of things to complete the connection.

In the case of one or more flanges formed on the end part of said fixed bolt, the width of said arc guide groove is longer than the diameter of said fixed bolt and shorter than the diameter of the flange on the end part of said fixed bolt, and the diameter of arc end part of said arc guide groove is longer than that of said flange. When the buckling unit is rotated, the arc guide groove can also buckle the flange of said fixed bolt to complete the connection.

BRIEF DESCRIPTION OF THE DRAWINGS

Some preferred embodiments of the rotating connector proposed by the present invention are hereinafter detailed by referring to the drawings.

DETAILED DESCRIPTION

Figures 1, 2:
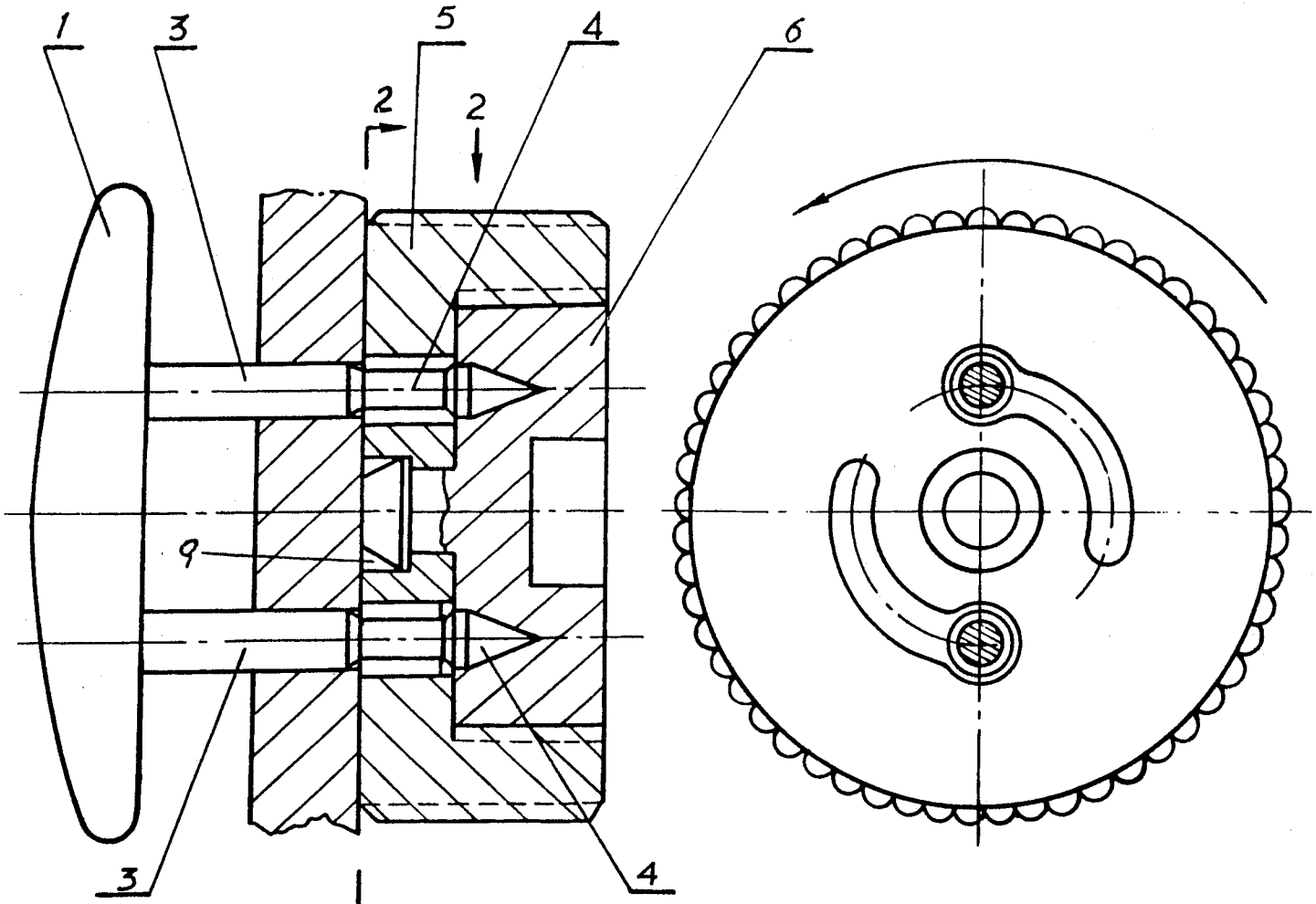
FIG. 1 is a sectional view of the first embodiment of the rotating connector proposed by the present invention, when the rotating connector is connected for use.
FIG. 2 is a A—A sectional view on FIG. 1.
Figure 4:
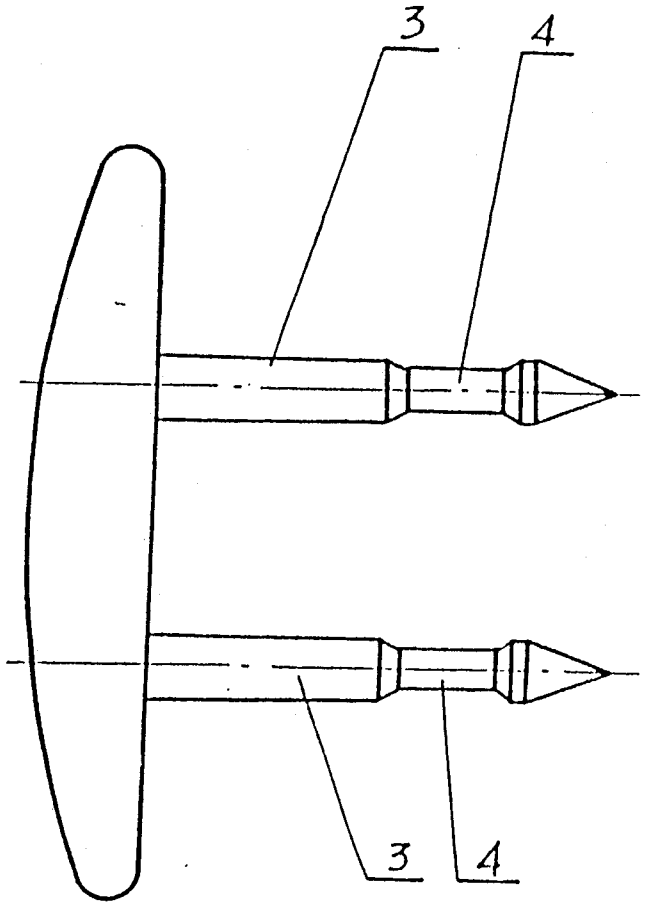
FIG. 4 is a lateral view of the fixed unit shown on FIG. 3.
Figure 3:
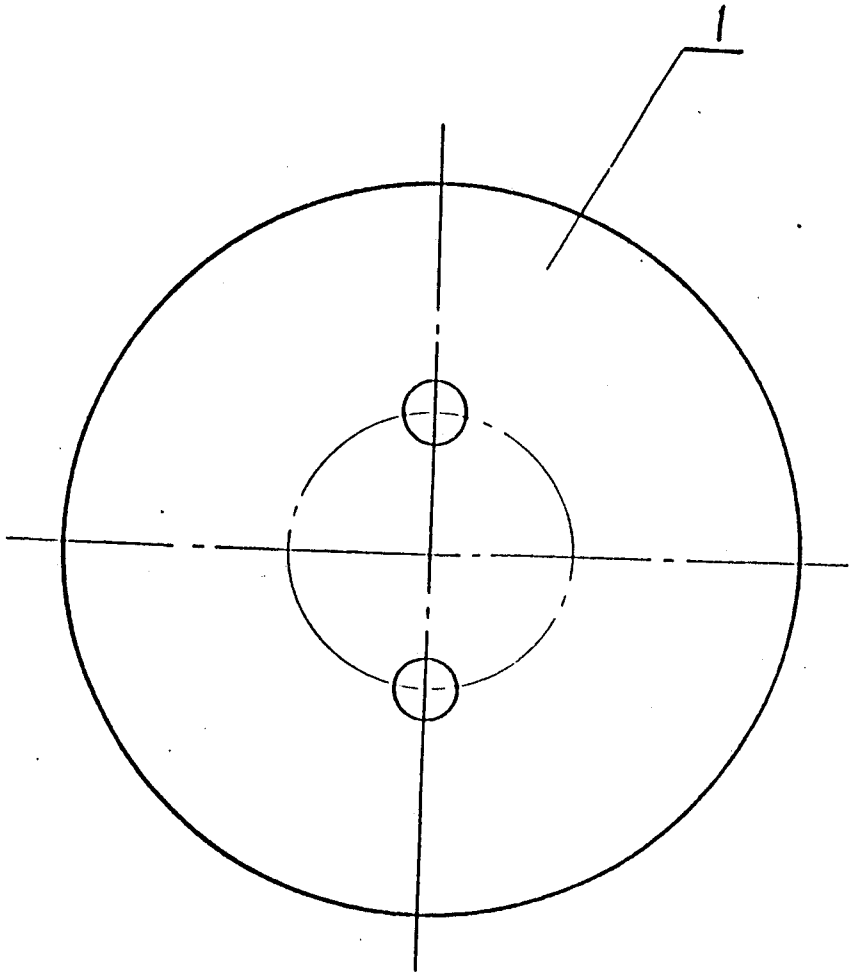
FIG. 3 is a front view of the fixed unit on the embodiment shown on FIG. 1.
Figure 6:
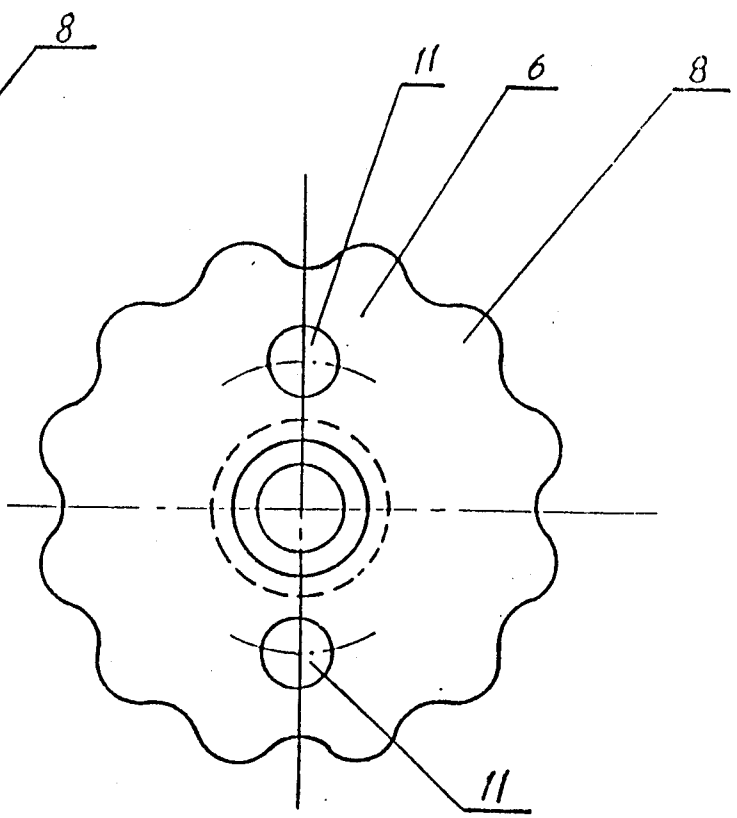
FIG. 6 is a lateral view of the plug-in block shown on FIG. 5.
Figure 5:
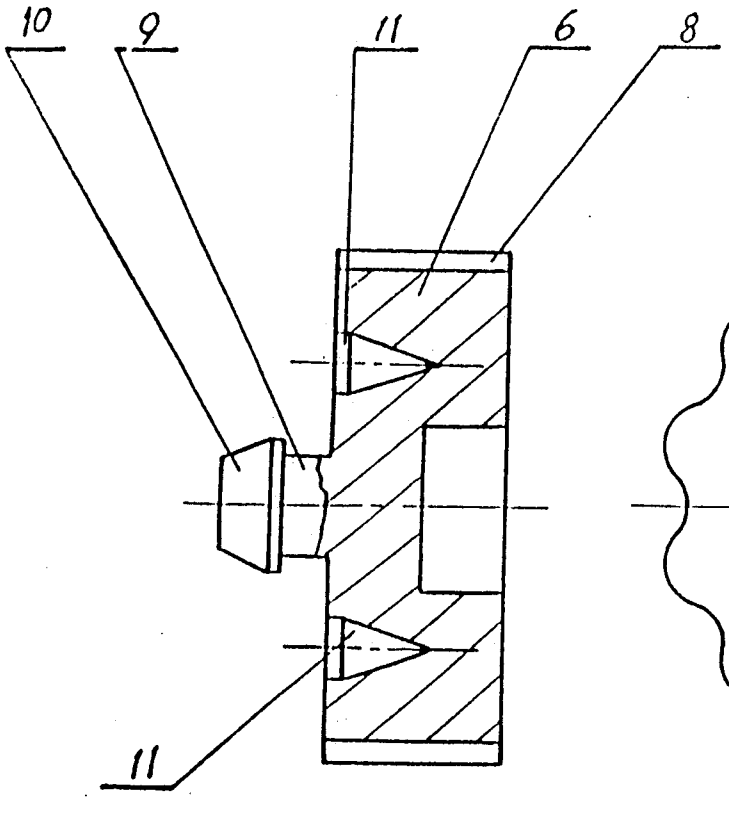
FIG. 5 is a sectional view of the plug-in block on the embodiment shown on FIG. 1.
Figures 7, 8:
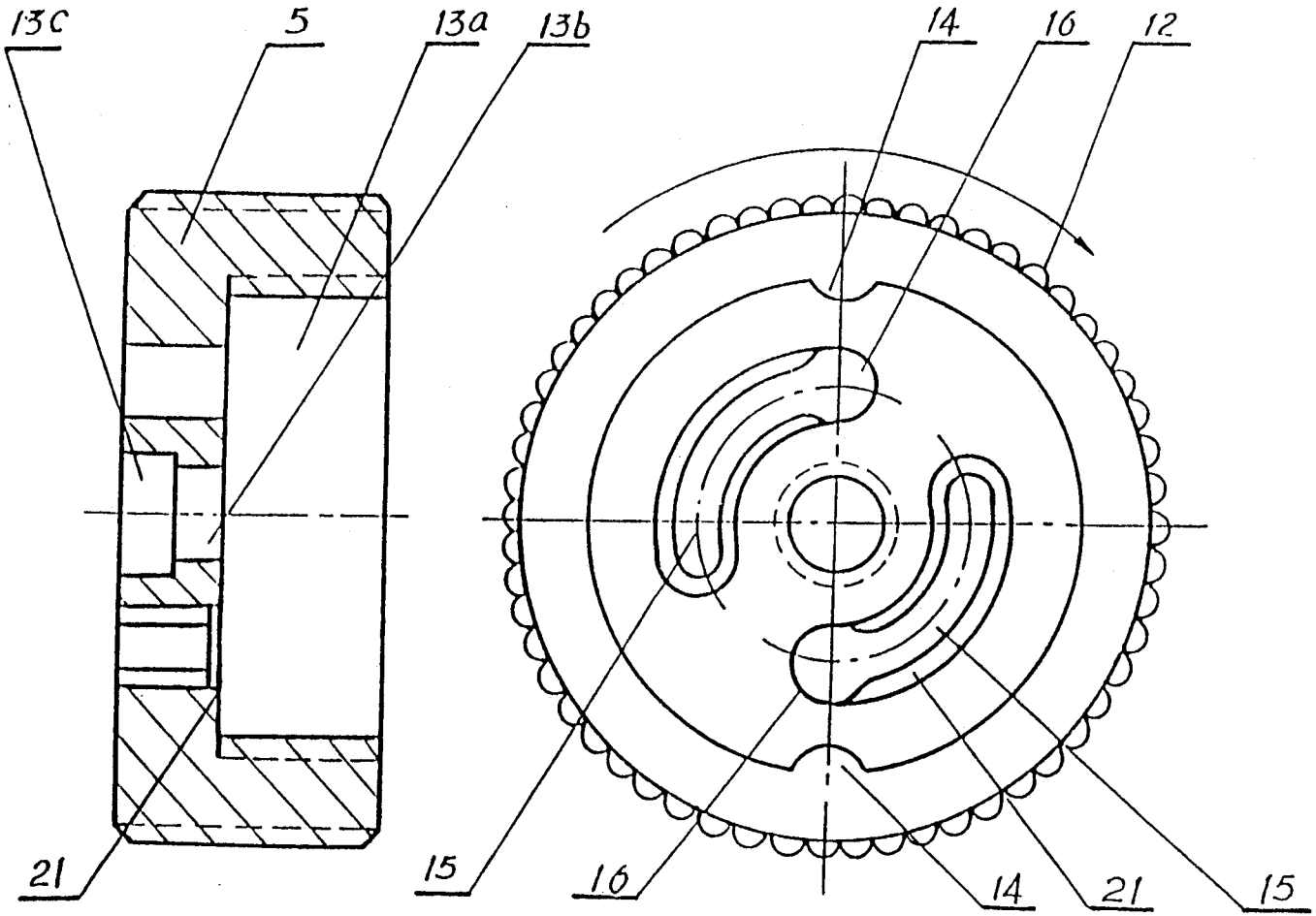
FIG. 7 is a sectional view of the buckling unit on the embodiment shown on FIG. 1.
FIG. 8 is a lateral view of the buckling unit shown on FIG. 7.

Referring to FIG. 1 and FIG. 2, the rotating connector proposed by the present invention is composed of a fixed unit 1 and a combined fastening part 2. Referring to FIG. 3 and FIG. 4, the fixed unit 1 may be a button or a badge etc. needed for assembling. Two parallel fixed bolts 3 are perpendicularly fixed on one side of said fixed unit 1. A neck section 4 is formed on the end part of each fixed bolt. The head of said fixed bolt 3 is taper. Said combined fastening part 2 is composed of a buckling unit 5 and a plug-in block 6. Referring to FIG. 5 and FIG. 6, the plug-in block 6 is a circular block on the whole, on which shape of said tooth is arc. A jack-post 9 which is extended outward is concentrically fixed on the center of one side of said plug-in block 6. A taper flange 10 is formed on the end of said jack-post 9. Two rabbets 11 are formed on the side, from which the jack-post 9 is extended outward, of said plug-in block 6 and around the jack-post 9. The shape and the dimension of said rabbets 11 is corresponded to those of the head of said fixed bolts 3. The interior shape of said rabbet 11 is taper. The distance between the center line of the rabbet 11 and the center line of said plug-in block 6 is equal to that between the center line of said fixed bolt 3 and the center line of said fixed unit 1. Referring to FIG. 7 and FIG. 8, said buckling unit 5 is circular, on which periphery some teeth 12 are arranged to avoid sliding while which is held to rotate. A cavity consisted of three concentric cylinder cavities 13*a*, 13*b*, 13*c* which are communicated with one and another is formed in the center of said buckling unit 5. Two flanges extended toward the center line of said buckling unit 5 are symmetrically formed on the interior periphery of said cylinder cavity 13*a*. The diameter of said cylinder cavity 13*a* is slightly longer than the longest diameter of the envelope line of the exterior periphery of said plug-in block 6. Two arc guide grooves 15 are axisymmetrically formed on the buckling unit 5. The radius of the center line of said arc guide groove, i.e., the radius of the arc by which the width of said arc guide groove 15 is evenly divided, is equal to half the central distance between two fixed bolts 3 on said fixed unit 1. The corresponding end of each arc guide groove 15 is an arc part 16, which diameter is longer than that of said fixed bolt 3 and the width of said arc guide groove is longer than the diameter of the neck section 4 on the fixed bolt 3 and shorter than the diameter of the fixed bolt 3. some arc shallow grooves 21 may be arranged on the end wall of the largest cylinder cavity 13*a* of the "I" shape cavity, which center line coincides with the center line of the corresponding arc guide groove 15 and which number is equal to the number of the arc guide grooves 15, and which width is equal to the diameter of the end arc part 16 of the arc guide groove 15 and which depth decreases progressively from the end arc part 16 to the other end of the arc guide groove 15.

After the combined fastening part 2 has been assembled, the rabbets 11 on the plug-in block 6 are aligned with the end arc parts 16 of the arc guide groove 15. The fixed bolts 3 pierce through the clothing or other articles of daily use, and pass through the end arc parts 16 of the arc guide grooves, and are inserted into the corresponding rabbets 11 on the plug-in block 6, and then the buckling unit 5 is rotated relative to the plug-in block 6 to make the neck section 4 on the fixed bolt 3 close to the other end of the arc guide groove 15, and therefore, two edges of the arc guide groove 15 are close to two sides of the neck section 4 on the fixed bolt 3 so that the neck section 4 is buckled by the edges of the arc guide groove 15 to complete the connection.

Figure 10:
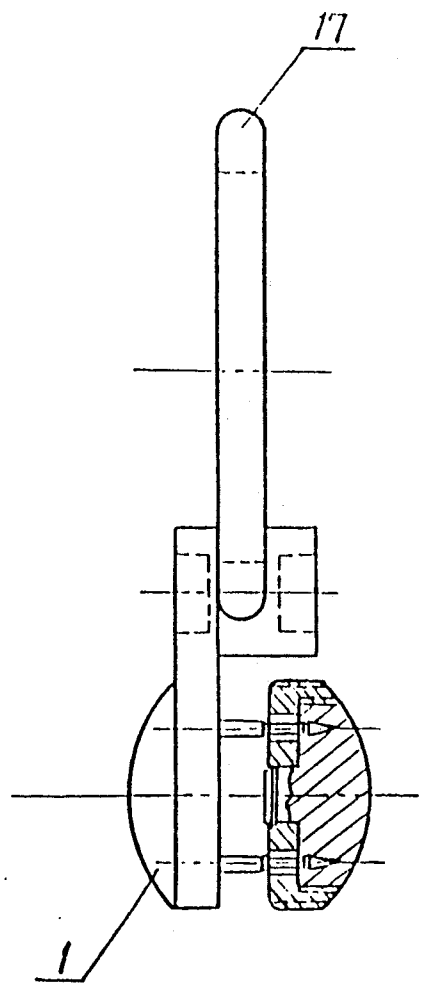
FIG. 10 is a lateral view of the second embodiment shown on FIG. 9.
Figure 9:
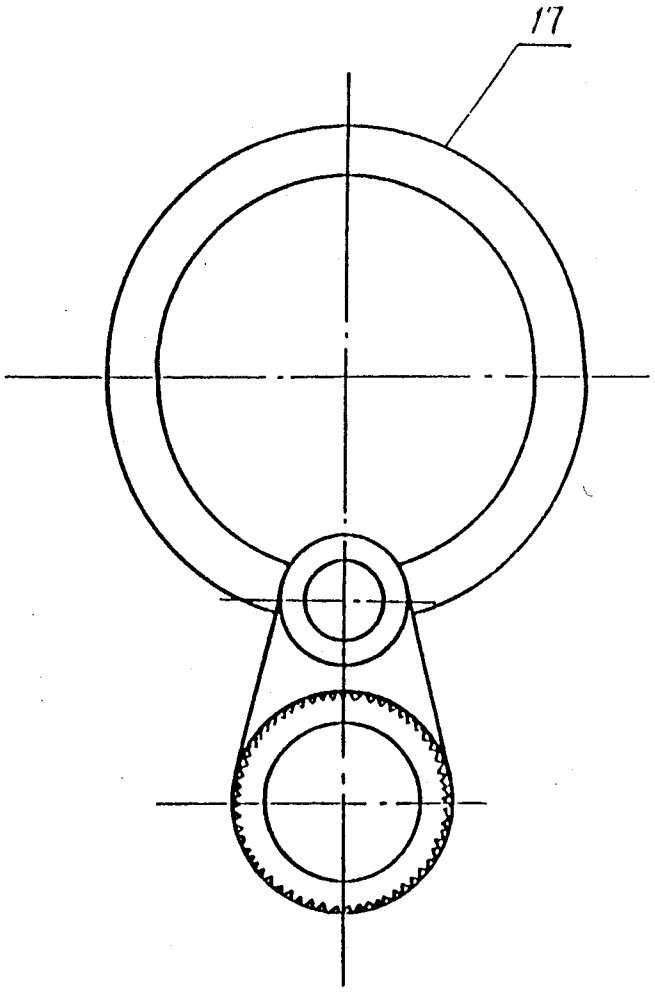
FIG. 9 is a front view of the second embodiment of the present invention, indicating the connector used for curtain catch.

FIG. 9 and FIG. 10 indicate the second embodiment of the connector proposed by the present invention, wherein, the connector is used for curtain catch. The characteristic, which is different from the first embodiment, is that the fixed unit 1 is combined with the curtain hoist link 17 in this embodiment.

Figure 12:
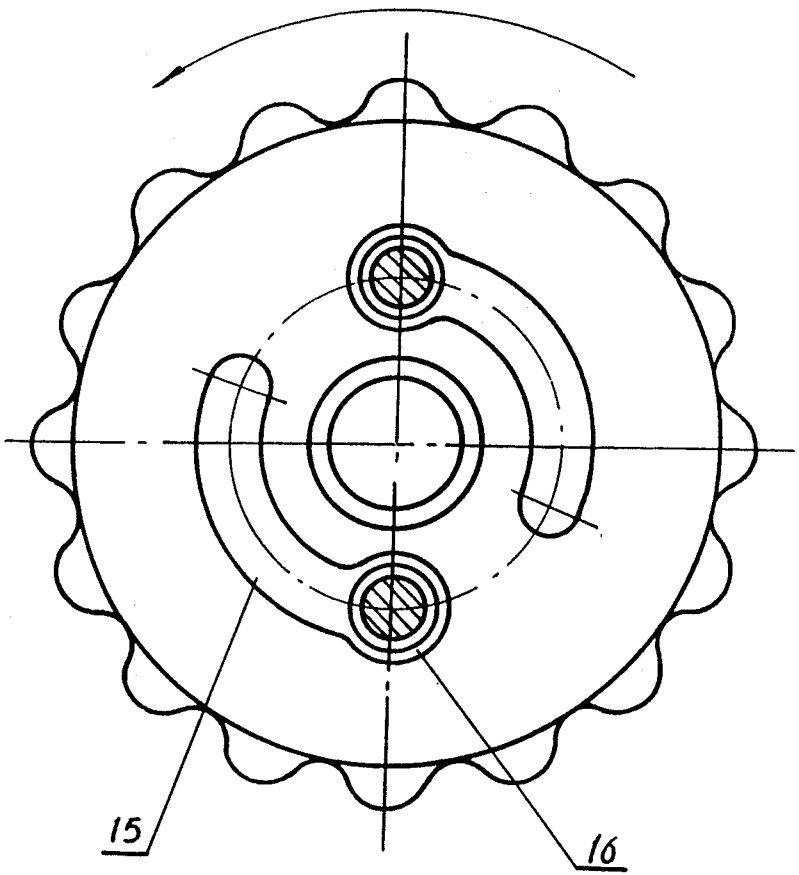
FIG. 12 is a B—B sectional view on FIG. 11.
Figure 11:
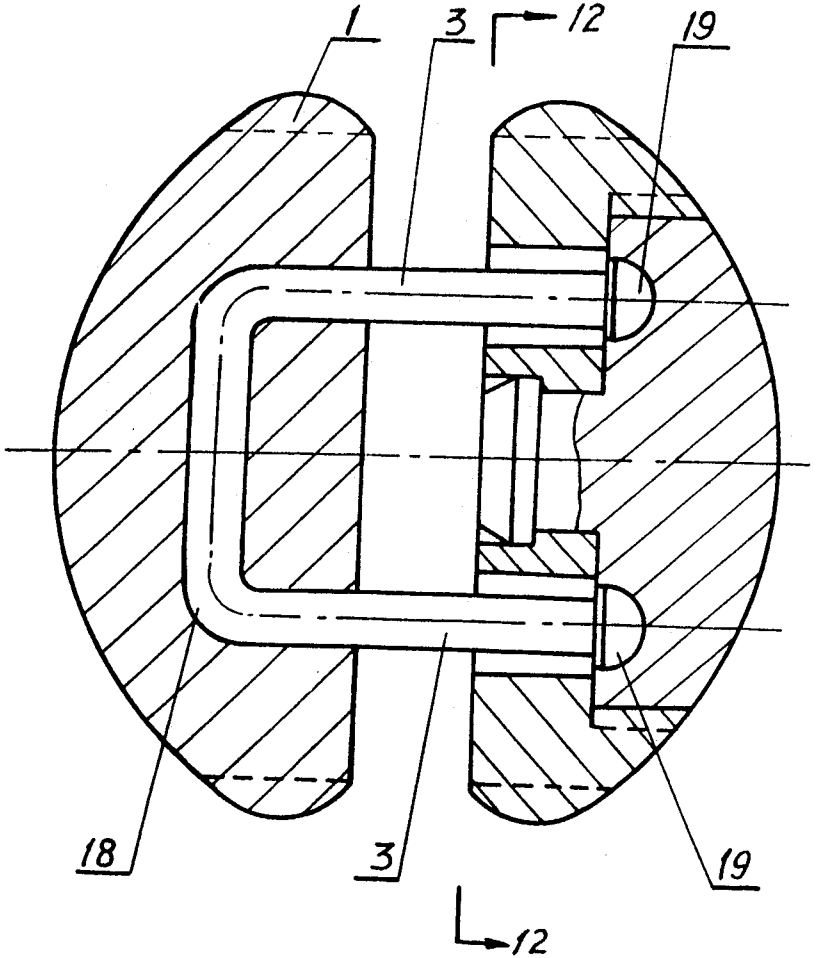
FIG. 11 is a sectional view of the third embodiment of the present invention, when the connector is connected for use.

FIG. 11 and FIG. 12 indicate the third embodiment of the connector proposed by the present invention. The characteristics, which are different from the first embodiment, are that two fixed bolts 3 are formed into the shape of the letter "U" in the third embodiment, which bottom 18 is embeded in the fixed unit 1 so as to improve strength, and a hemispherical flange 19 is formed on the head of each fixed bolt 3, and the width of the arc guide groove 15 is longer than the diameter of the fixed bolt 3 and shorter than the diameter of the end hemispherical flange 19 of the fixed bolt 3, and the diameter of the end arc part 16 of the arc guide groove 15 is longer than the diameter of the end hemispherical flange 19.

Figure 13:
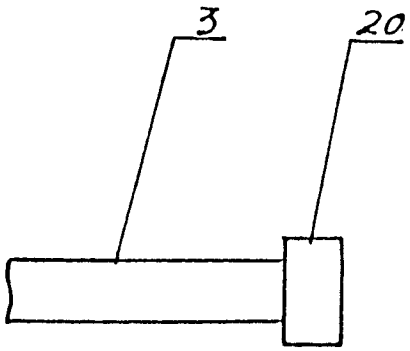
FIG. 13 and FIG. 14 are two diagrammetic views of the end flanges of the fixed bolts of the fifth embodiment of the present invention, indicating that the flanges are flat flanges.
Figure 14:
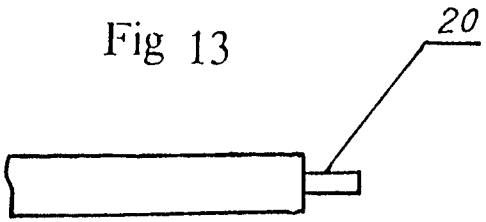

FIG. 13 and FIG. 14 indicate the end part of the fixed bolt 3 of the fourth embodiment of the connector proposed by the present invention. The characteristics, which are different from the third embodiment, are that, in the fourth embodiment, a flat head 20 which traverse dimension is longer than the diameter of the fixed bolt 3 is formed on the end of said fixed bolt 3, and the width of the arc guide groove 15 is longer than the diameter of the fixed bolt 3 and shorter than the traverse dimension of the flat head 20, and the rabbet 11 is a cylinder hole, which diameter is corresponded to the traverse dimension of the flat head 20.

Figure 15:
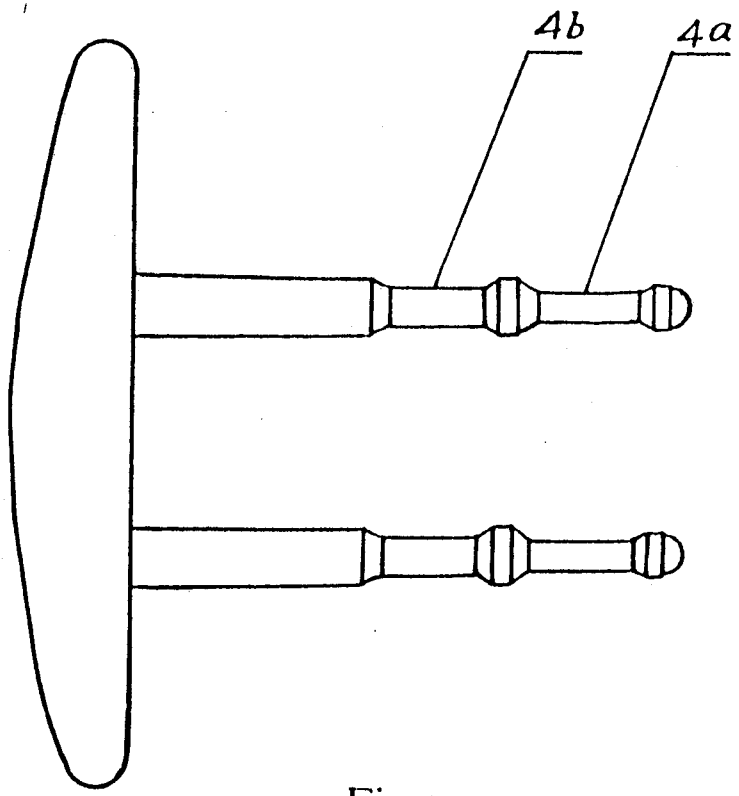
FIG. 15 is a diagrammetic view of the fixed unit of the fourth embodiment of the present invention, indicating that there are two neck sections on the bolt.

FIG. 15 indicates the end part of the fixed bolt 3 of the fifth embodiment of the connector proposed by the present invention. The characteristic, which is different from the first embodiment, is that two separate neck sections 4*a*, 4*b* are arranged on the end part of the fixed bolt 3.

Figure 16:
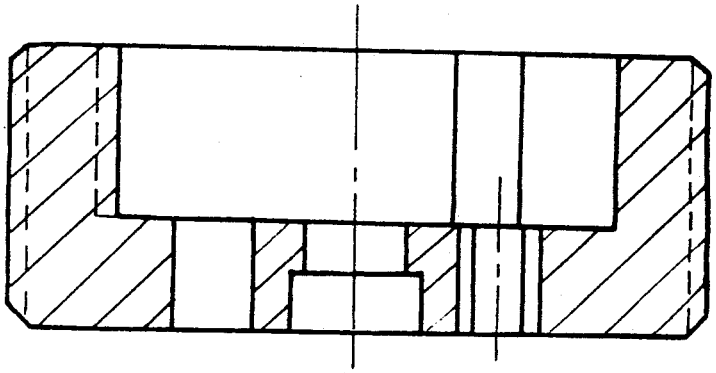
FIG. 16 and FIG. 17 are a front sectional view and a lateral view of the buckling unit of the sixth embodiment of the present invention.
Figure 17:
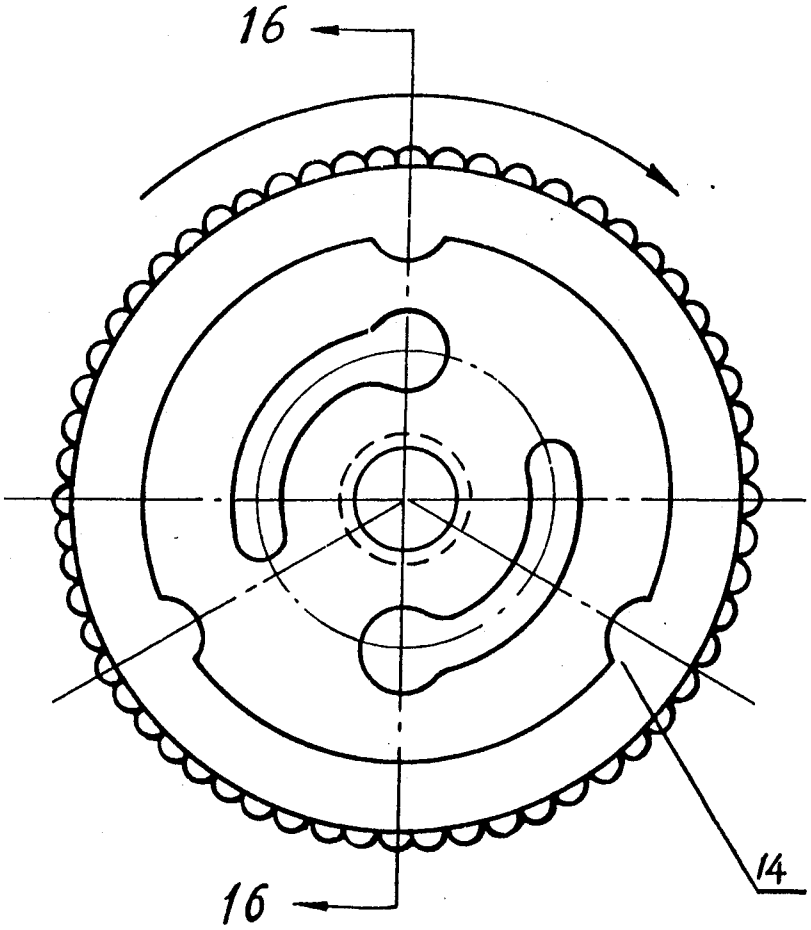

FIG. 16 and FIG. 17 indicate the buckling unit of the sixth embodiment of the present invention. The characteristics, which are different from the first embodiment, are that there is no arc shallow groove 21 and there are three arc flanges 14 evenly arranged on the interior periphery of the largest cylinder cavity in the sixth embodiment.

What is claimed is:

1. A rotating connector, wherein, said rotating connector includes a fixed unit and a combined fastening part;

two parallel fixed bolts which are extended outward are fixed on one said of said fixed unit, and a neck section is formed on the end part of each fixed bolt;

said combined fastening part is composed of a buckling unit and a plug-in block; said plug-in block is circular, and a jack-post which is extended outward is concentrically formed on one side of said plug-in block, and a taper flange is formed on the end of said jack-post; two rabbets which are corresponded to the heads of said fixed bolts on said fixed unit are formed on the plug-in block and around said jack-post, and the number and position, relative to each other and to the center line of the plug-in block, of the rabbets are equal to the number and position, relative to each other and to the center line of the fixed unit, of the fixed bolts, and some teeth are evenly arranged on the exterior periphery of said plug-in block;

on the exterior periphery of said buckling unit some teeth are arranged to avoid sliding while which is held to rotate; a cavity consisted of three concentric cylinder cavities which are communicated with one and another is concentrically formed in said buckling unit; two arc flanges extended toward the center line of said buckling unit are symmetrically formed on the interior periphery of the largest cylinder cavity, which diameter is slightly longer than the longest diameter of the envelope line of the exterior periphery of said plug-in block; the diameter of the middle cylinder cavity is corresponded to the diameter of said jack-post, and the diameter of the other end cylinder cavity is longer than that of the middle cylinder cavity to receive the end flange of said jack-post; some arc guide grooves which are communicated with the largest cylinder cavity are formed on the buckling unit and around the jack-post, which number is equal to that of the fixed bolts on the fixed unit, and which width is shorter than the diameter of said fixed bolt and longer than the diameter of the neck section on the end part of said fixed bolt; the corresponding end of each arc guide groove is arc, which diameter is longer than that of the head of said fixed bolt; the radius of center line of the arc guide groove, i.e., the radius of the arc by which the width of said arc guide groove is evenly divided is equal to half the central distance between two fixed bolts on said fixed unit;

the plug-in block can be pressed and inserted into the cylinder cavity in the buckling unit, and the buckling unit can be rotated relative to the plug-in block and cannot move axially relative to the plug-in block because the end flange of the jack-post is buckled; the fixed bolts on the fixed unit can pass through the end arc part of the arc guide groove and the heads of said fixed bolts can be inserted into the rabbets on said plug-in block.

2. A rotating connector, wherein, said rotating connector includes a fixed unit and a combined fastening part;

more than two parallel fixed bolts which are extended outward are fixed on one said of said fixed unit, and a neck section is formed on the end part of each fixed bolt;

said combined fastening part is composed of a buckling unit and a plug-in block; said plug-in block is circular, and a jack-post which is extended outward is concentrically formed on one side of said plug-in block, and a taper flange is formed on the end of said jack-post; two rabbets which are corresponded to the heads of said fixed bolts on said fixed unit are formed on the plug-in block and around said jack-post, and the number and position, relative to each other and to the center line of the plug-in block, of the rabbets are equal to the number and position, relative to each other and to the center line of the fixed unit, of the fixed bolts, and some teeth are evenly arranged on the exterior periphery of said plug-in block;

on the exterior periphery of said buckling unit some teeth are arranged to avoid sliding while which is held to rotate; a cavity consisted of three concentric cylinder cavities which are communicated with one and another is concentrically formed in said buckling unit; two arc flanges extended toward the center line of said buckling unit are symmetrically formed on the interior periphery of the largest cylinder cavity, which diameter is slightly longer than the longest diameter of the envelope line of the exterior periphery of said plug-in block; the diameter of the middle cylinder cavity is corresponded to the diameter of said jack-post, and the diameter of the other end cylinder cavity is longer than that of the middle cylinder cavity to receive the end flange of said jack-post; some are guide grooves which are communicated with the largest cylinder cavity are formed on the buckling unit and around the jack-post, which number is equal to that of the fixed bolts on the fixed unit, and which width is shorter than the diameter of said fixed bolt and longer than the diameter of the neck section on the end part of said fixed bolt; the corresponding end of each arc guide groove is arc, which diameter is longer than that of the head of said fixed bolt; the radius of center line of the arc guide groove, i.e., the radius of the arc by which the width of said arc guide groove is evenly divided is equal to the radius of the circle on which periphery the center lines of the fixed bolts on said fixed unit are situated;

the plug-in block can be pressed and inserted into the cylinder cavity in the buckling unit, and the buckling unit can be rotated relative to the plug-in block and cannot move axially relative to the plug-in block because the end flange of the jack-post is buckled; the fixed bolts on the fixed unit can pass through the end arc part of the arc guide groove and the heads of said fixed bolts can be inserted into the rabbets on said plug-in block.

3. A rotating connector, wherein, said rotating connector includes a fixed unit and a combined fastening part;

two parallel fixed bolts which are extended outward are fixed on one said of said fixed unit, and a flange is formed on the end part of each fixed bolt;

said combined fastening part is composed of a buckling unit and a plug-in block; said plug-in block is circular, and a jack-post which is extended outward is concentrically formed on one side of said plug-in block, and a taper flange is formed on the end of said jack-post; two rabbets which are corresponded to the heads of said fixed bolts on said fixed unit are formed on the plug-in block and around said jack-post, and the number and position, relative to each other and to the center line of the plug-in block, of the rabbets are equal to the number and position, relative to each other and to the center line of the fixed unit, of the fixed bolts, and some teeth are evenly arranged on the exterior periphery of said plug-in block;

on the exterior periphery of said buckling unit some teeth are arranged to avoid sliding while which is held to rotate; a cavity consisted of three concentric cylinder cavities which are communicated with one and another is concentrically formed in said buckling unit; two arc flanges extended toward the center line of said buckling unit are symmetrically formed on the interior periphery of the largest cylinder cavity, which diameter is slightly longer than the longest diameter of the envelope line of the exterior periphery of said plug-in block; the diameter of the middle cylinder cavity is corresponded to the diameter of said jack-post, and the diameter of the other end cylinder cavity is longer than that of the middle cylinder cavity to receive the end flange of said jack-post; some arc guide grooves which are communicated with the largest cylinder cavity are formed on the buckling unit and around the jack-post, which number is equal to that of the fixed bolts on the fixed unit, and which width is longer than the diameter of said fixed bolt and shorter than the diameter of the flange on the end part of said fixed bolt; the corresponding end of each arc guide groove is arc, which diameter is longer than that of the head of said fixed bolt; the radius of center line of the arc guide groove, i.e., the radius of the arc by which the width of said arc guide groove is evenly divided is equal to half the central distance between two fixed bolts on said fixed unit;

the plug-in block can be pressed and inserted into the cylinder cavity in the buckling unit, and the buckling unit can be rotated relative to the plug-in block and cannot move axially relative to the plug-in block because the end flange of the jack-post is buckled; the fixed bolts on the fixed unit can pass through the end arc part of the arc guide groove and the heads of said fixed bolts can be inserted into the rabbets on said plug-in block.

4. A rotating connector as claimed in claim 1 or 2 or 3, wherein, said fixed bolts are welded on one side of the fixed unit.

5. A rotating connector as claimed in claim 1 or 3, wherein, said fixed bolt is the shape of the letter "U" and the bottom of said fixed bolt is embeded in the fixed unit.

6. A rotating connector as claimed in claim 1 or 2, wherein, the head of each fixed bolt on the fixed unit is taper, and said rabbets are taper blind holes.

7. A rotating connector as claimed in claim 3, wherein, the head of each fixed bolt on the fixed unit is hemispherical, and said rabbets are hemispherical blind holes.

8. A rotating connector, wherein, said rotating connector includes a fixed unit and a combined fastening part;

more than two parallel fixed bolts which are extended outward are fixed on one said of said fixed unit, and more than one neck section are alternatively formed on the end part of each fixed bolt;

said combined fastening part is composed of a buckling unit and a plug-in block; said plug-in block is circular, and a jack-post which is extended outward is concentrically formed on one side of said plug-in block, and a taper flange is formed on the end of said jack-post; two rabbets which are corresponded to the heads of said fixed bolts on said fixed unit are formed on the plug-in block and around said jack-post; and the number and position, relative to each other and to the center line of the plug-in block, of the rabbets are equal to the number and position, relative to each other and to the center line of the fixed unit, of the fixed bolts, and some teeth are evenly arranged on the exterior periphery of said plug-in block;

on the exterior periphery of said buckling unit some teeth are arranged to avoid sliding while which is held to rotate; a cavity consisted of three concentric cylinder cavities which are communicated with one and another is concentrically formed in said buckling unit; two arc flanges extended toward the center line of said buckling unit are symmetrically formed on the interior periphery of the largest cylinder cavity, which diameter is slightly longer than the longest diameter of the envelope line of the exterior periphery of said plug-in block; the diameter of the middle cylinder cavity is corresponded to the diameter of said jack-post, and the diameter of the other end cylinder cavity is longer than that of the middle cylinder cavity to receive the end flange of said jack-post; some arc guide grooves which are communicated with the largest cylinder cavity are formed on the buckling unit and around the jack-post, which number is equal to that of the fixed bolts on the fixed unit, and which width is shorter than the diameter of said fixed bolt and longer than the diameter of the neck section on the end part of said fixed bolt; the corresponding end of each arc guide groove is arc, which diameter is longer than that of the head of said fixed bolt; the radius of center line of the arc guide groove, i.e., the radius of the arc by which the width of said arc guide groove is evenly divided is equal to the radius of the circle on which periphery the center lines of the fixed bolts on said fixed unit are situated;

the plug-in block can be pressed and inserted into the cylinder cavity in the buckling unit, and the buckling unit can be rotated relative to the plug-in block and cannot move axially relative to the plug-in block because the end flange of the jack-post is buckled; the fixed bolts on the fixed unit can pass through the end arc part of the arc guide groove and the heads of said fixed bolts can be inserted into the rabbets on said plug-in block.

9. A rotating connector, wherein, said rotating connector includes a fixed unit and a combined fastening part;

two parallel fixed bolts which are extended outward are fixed on one said of said fixed unit, and a flat end flange which traverse dimension is longer than the diameter of the fixed bolt is formed on the end part of each fixed bolt;

said combined fastening part is composed of a buckling unit and a plug-in block; said plug-in block is circular, and a jack-post which is extended outward is concentrically formed on one side of said plug-in block, and a taper flange is formed on the end of said jack-post; two rabbets which are corresponded to the heads of said fixed bolts on said fixed unit are formed on the plug-in block and around said jack-post, and the number and position, relative to each other and to the center line of the plug-in block, of the rabbets are equal to the number and position, relative to each other and to the center line of the fixed unit, of the fixed bolts, and some teeth are evenly arranged on the exterior periphery of said plug-in block;

on the exterior periphery of said buckling unit some teeth are arranged to avoid sliding while which is held to rotate; a cavity consisted of three concentric cylinder cavities which are communicated with one and another is concentrically formed in said buckling unit; two arc flanges extended toward the center line of said buckling unit are symmetrically formed on the interior periphery of the largest cylinder cavity, which diameter is slightly longer than the longest diameter of the envelope line of the exterior periphery of said plug-in block; the diameter of the middle cylinder cavity is corresponded to the diameter of said jack-post, and the diameter of the other end cylinder cavity is longer than that of the middle cylinder cavity to receive the end flange of said jack-post; some arc guide grooves which are communicated with the largest cylinder cavity are formed on the buckling unit and around the jack-post, which number is equal to that of the fixed bolts on the fixed unit, and which width is longer than the diameter of said fixed bolt and shorter than the diameter of the flat end flange on the end part of said fixed bolt; the corresponding end of each arc guide groove is arc, which diameter is longer than that of the head of said fixed bolt; the radius of center line of the arc guide groove, i.e., the radius of the arc by which the width of said arc guide groove is evenly divided is equal to half the central distance between two fixed bolts on said fixed unit;

the plug-in block can be pressed and inserted into the cylinder cavity in the buckling unit, and the buckling unit can be rotated relative to the plug-in block and cannot move axially relative to the plug-in block because the end flange of the jack-post is buckled; the fixed bolts on the fixed unit can pass through the end arc part of the arc guide groove and the heads of said fixed bolts can be inserted into the rabbets on said plug-in block.

10. A rotating connector for material comprising:

a fixed base unit for disposing above the material, including a plurality of parallel, radially spaced-apart downwardly extending bolts affixed to the base unit, each of the bolts including an end portion with a reduced thickness neck section formed on the end portion, the end portion terminating in a tip spaced apart from the neck section;

a generally circular plug-in block for disposing below the material, the plug-in block having an upwardly protruding jack post terminating in a tapered flange, a plurality of rabbets in the upper face in alignment with the bolts, and a plurality of circumferentially outwardly protruding teeth; and a generally circular buckling unit having a top face for disposing below the material, the buckling unit including:

a substantially cylindrical plug-in cavity therein of a diameter adapted to receive the plug-in block, the plug-in block being rotatable in the plug-in cavity, a middle cylindrical cavity and an upper cylindrical cavity arranged axially of the plug-in cavity, the upper cylindrical cavity adapted to receive the tapered flange to axially lock the tapered flange therein, and a plurality of arcuate guide grooves in the top face of the buckling unit and extending downward into the plug-in cavity.

11. The connector of claim 10, wherein the grooves each include a generally circular groove end, the grooves each having a width greater than the neck section of the bolts and less than the tip of the bolts, the grooves having an arcuate length less than an arcuate distance between the bolts.

12. The connector of claim 10, wherein a diameter of the middle cylindrical cavity is greater than a width of the jack post.

13. The connector of claim 10, wherein the plurality of bolts, the plurality of rabbets, and the plurality of guide grooves all are equal in number.

14. The connector of claim 10, wherein the bolts comprise a plurality of prongs unitarily formed in an inverted "U"-shaped bolt member affixed to the base unit.

15. The connector of claim 10, wherein the end portions of the bolts include a plurality of spaced-apart, reduced-diameter neck portions.

16. The connector of claim 10, wherein the tip of each bolt comprises a flat end flange having an overall width greater than the bolt end portion.

17. The connector of claim 13, wherein the arcuate length of the grooves is less than the arcuate distance between the bolts.

18. The connector of claim 17, wherein a radius of the guide grooves has a length equal to one-half the distance between two of the bolts.

19. The connector of claim 18, wherein the bolts comprise a plurality of prongs integrally formed as a single "U"-shaped bolt member affixed to the base unit.

20. The connector of claim 19, wherein the tip is a generally convex hemisphere and the rabbets comprise generally concave hemispherical recesses.

21. The connector of claim 18, wherein the tip is generally conical and wherein the rabbets are blind generally conical holes.

22. The connector of claim 18, wherein at least two bolts are provided.

23. The connector of claim 18, wherein at least three bolts are provided.

24. The connector of claim 18, wherein the end portions of the bolts include a plurality of spaced-apart, reduced-diameter neck portions.

25. The connector of claim 18, wherein the tip of each bolt comprises a flat end flange having an overall width greater than the bolt end portion and wherein the grooves each include a generally circular groove end, the grooves each having a width slightly greater than the neck section of the bolts and slightly less than the tip of the bolts, the grooves having an arcuate length less than the arcuate distance between the bolts.

* * * * *